US011508389B2

(12) United States Patent
Wada

(10) Patent No.: US 11,508,389 B2
(45) Date of Patent: Nov. 22, 2022

(54) AUDIO SIGNAL PROCESSING APPARATUS, AUDIO SIGNAL PROCESSING SYSTEM, AND AUDIO SIGNAL PROCESSING METHOD

(71) Applicant: Audio-Technica Corporation, Tokyo (JP)

(72) Inventor: Ariisa Wada, Tokyo (JP)

(73) Assignee: Audio-Technica Corporation, Tokyo (JP)

( * ) Notice: Subject to any disclaimer, the term of this patent is extended or adjusted under 35 U.S.C. 154(b) by 1 day.

(21) Appl. No.: 17/173,801

(22) Filed: Feb. 11, 2021

(65) Prior Publication Data

US 2021/0256989 A1 Aug. 19, 2021

(30) Foreign Application Priority Data

Feb. 17, 2020 (JP) ..... JP2020-024213

(51) Int. Cl.
*G10L 21/0232* (2013.01)

(52) U.S. Cl.
CPC ..... *G10L 21/0232* (2013.01)

(58) Field of Classification Search
CPC ..... G10L 21/0232
See application file for complete search history.

(56) References Cited

U.S. PATENT DOCUMENTS 5,857,000 A * 1/1999 Jar-Ferr ..... G10L 21/0364 375/240
6,233,550 B1 * 5/2001 Gersho ..... G10L 19/18 704/214
2012/0127341 A1 * 5/2012 Han ..... H04N 5/911 348/E5.122
2012/0170766 A1 * 7/2012 Alves ..... H04R 1/1083 381/71.11
2017/0048641 A1 * 2/2017 Franck ..... G10L 19/022

OTHER PUBLICATIONS

"Recursive discrete Fourier transform with unified IIR filter structures" Yang et al., Signal processing 82.1 (2002): pp. 31-41. (Year: 2002).*
"Window Functions and Their Applications in Signal Processing," Prabhu, Taylor & Francis, 2014. p. 152 (Year: 2014).*
Tsujii: "Basics of Digital Signal Processing", The Institute of Electronics, Information and Communication Engineers, pp. 99-102, 1988-03.
Ono: "Fundamentals and applications of short-time Fourier transform", Journal of the Japan Society, vol. 72, No. 12, pp. 764-769, 2016.

* cited by examiner

*Primary Examiner* — Bhavesh M Mehta
*Assistant Examiner* — Edward Tracy, Jr.
(74) *Attorney, Agent, or Firm* — WCF IP

(57) ABSTRACT

To provide an audio signal processing apparatus, an audio signal processing system, and an audio signal processing method that include: a first converting part that converts an input data sequence of an audio signal into frequency data using an IIR system DFT at each processing timing, a window processing part that performs window processing on the frequency data using a window function, a signal processing part that performs predetermined signal processing on the frequency data on which window processing has been performed, and a second converting part that converts the frequency data, on which the signal processing has been performed, into a time-axis data sequence.

8 Claims, 3 Drawing Sheets

| | |
|---|---|
| $\alpha_0$ | 0.85555079731991600 |
| $\alpha_1$ | -0.26865214372169600 |
| $\alpha_2$ | -0.22568201623614200 |
| $\alpha_3$ | -0.16685295099808800 |
| $\alpha_4$ | -0.10662243502099200 |
| $\alpha_5$ | -0.05697721398805180 |
| $\alpha_6$ | -0.02390676639545560 |
| $\alpha_7$ | -0.00685727095949074 |

FIG. 3

AUDIO SIGNAL PROCESSING APPARATUS, AUDIO SIGNAL PROCESSING SYSTEM, AND AUDIO SIGNAL PROCESSING METHOD

CROSS-REFERENCE TO RELATED APPLICATIONS

The present application claims priority to Japanese Patent Applications number 2020-024213, filed on Feb. 17, 2020. The contents of this application are incorporated herein by reference in their entirety.

BACKGROUND

A technique that frequency-converts a data sequence arranged in a time series into a frequency-domain data sequence first and then performs predetermined signal processing, and converts the frequency-domain data sequence into a time-domain data sequence again is known. As a method for converting the time-domain data sequence into the frequency-domain data sequence, a DFT, an IIR system DFT, or the like is known (for example, Non-Patent Document 1, "Basics of Digital Signal Processing," Shigeo Tsuji, the Institute of Electronics and Information Technology, pp. 99-103). Also, when processing an audio signal or the like whose frequency components change over time, a technique for processing the audio signal or the like while overlapping a window function such as a short-time Fourier transform is known (for example, Non-Patent Document 2, "Fundamentals and applications of short-time Fourier transform," Nobutaka, Ono, Journal of the Japan Acoustical Society, Vol. 72, No. 12 (2016), pp. 764-769).

When processing the audio signal or the like, however, there may be cases where a high processing speed, such as an allowable delay time of about 0.003 seconds or less, is required. The short-time Fourier transform in which the window function is overlapped cannot achieve such a high processing speed since a delay occurs depending on the overlapped time. Therefore, a technique capable of processing the audio signal or the like at a higher speed has been desired.

SUMMARY

The present disclosure focuses on this point, and its object is to process the audio signal or the like at higher speed while performing the frequency conversion.

A first aspect of the disclosure provides an audio signal processing apparatus including: a first converting part that converts an input data sequence of an audio signal into frequency data using an IIR system DFT at each processing timing; a window processing part that performs window processing on the frequency data using a window function; a signal processing part that performs predetermined signal processing on the frequency data on which the window processing has been performed; and a second converting part that converts the frequency data, on which the signal processing has been performed, into a time-axis data sequence.

A second aspect of the present disclosure provides an audio signal processing system including: an audio input device that outputs an input voice as an audio signal; and an audio signal processing apparatus that performs predetermined signal processing on the audio signal output from the audio input device, wherein the audio signal processing apparatus includes: an acquisition part that acquires a data sequence of an audio signal output by the audio input device; a first converting part that converts the data sequence of the audio signal into frequency data using an IIR system DFT at each processing timing; a window processing part that performs window processing on the frequency data using a window function; a signal processing part that performs the predetermined signal processing on the frequency data on which the window processing has been performed; and a second converting part that converts the frequency data, on which the signal processing has been performed, into a time-axis data sequence.

A third aspect of the present disclosure provides an audio signal processing method including the steps of converting an input data sequence of an audio signal into frequency data using an IIR system DFT at each processing timing; performing window processing on the frequency data using a window function; performing predetermined signal processing on the frequency data on which the window processing has been performed; and converting the frequency data, on which the signal processing has been performed, into a time-axis data sequence.

BRIEF DESCRIPTION OF THE DRAWINGS

FIG. 3 shows an example of a coefficient of a window function according to the present embodiment.

DETAILED DESCRIPTION

Hereinafter, the present disclosure will be described through exemplary embodiments, but the following exemplary embodiments do not limit the invention according to the claims, and not all of the combinations of features described in the exemplary embodiments are necessarily essential to the solution means of the invention.

Conventionally, a short-time Fourier transform that multiplies a data sequence arranged in a time series by a window function, frequency-converts the data sequence multiplied by the window function first and then performs predetermined signal processing on the frequency-converted data sequence, and coverts the frequency-converted data sequence into a time-domain data sequence again has been known. It has been known that a combination of such a conversion process from a time domain to a frequency domain and a conversion process from the frequency domain to the time domain can be performed using a DFT, IDFT, or the like. In the present embodiment, it is assumed that the DFT process includes an FFT process, and the IDFT process includes an IFFT process. Such signal processing using the DFT and the IDFT involve many complex multiplications. For this reason, a ratio of computer resources involved in the conversion to the entirety of computer resources increases, and this hinders implementation of other signal processing.

Also, in order to provide periodicity to the time-domain data sequence, the window function is formed such that values at both ends, i.e., the window's head and tail, are set to 0 and a value converges to 0 as it approaches the head or tail of the window. Therefore, even if a signal-processed frequency data sequence is converted into the time-domain data sequence, values of data corresponding to both ends of the window function and near both ends of the window function become 0 or almost 0. A method of shifting a window function by a predetermined value and applying the shifted window function to the time-domain data sequence is known, such as a method called overlap, for example.

Figure 1:
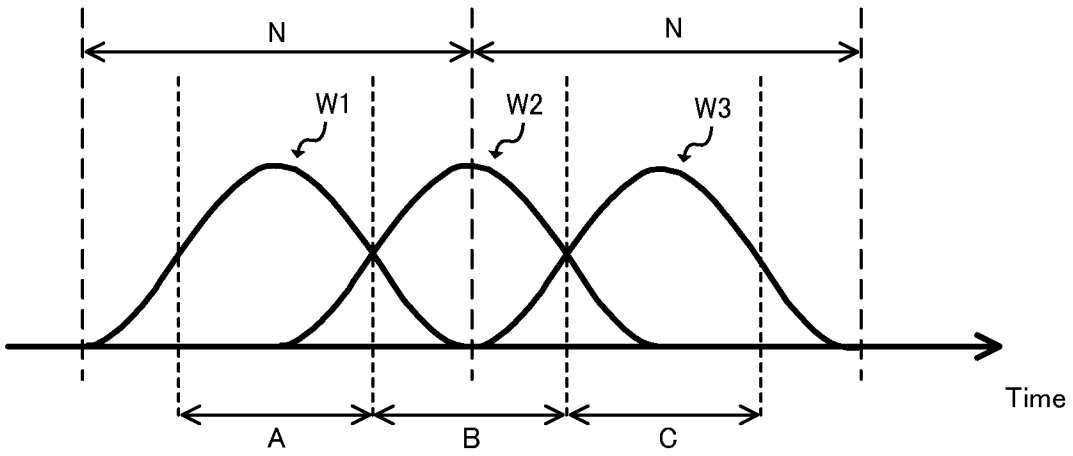
FIG. 1 illustrates a concept of half-overlap.

FIG. 1 illustrates a concept of half-overlap. In FIG. 1, the horizontal axis indicates the time and the vertical axis indicates the signal level. Here, the time width of one window function is defined as N. The time width N of the window function corresponds to the number of data points. The number of data points is 256, as an example. When a window function such as the one shown in FIG. 1 is multiplied by a time-domain data sequence, values of data corresponding to both ends of the window function and near both ends of the window function become 0 or almost 0. For example, when a window function W1, a window function W3, and so forth are applied to and multiplied by the time-domain data sequence for each time width N of the window function, values of a data sequence of a period B between the window function W1 and the window function W3 become 0 or close to 0.

Therefore, when the data sequence of the period B is frequency-converted and the time-domain data sequence is generated again from the frequency-converted data sequence, the value of the data becomes 0 or close to 0. In this case, it is conceivable to increase the value of the data corresponding to the decrease of the values in the window function by multiplying the data sequence of the period B by a constant, but the error also increases as the value of the data increases. Therefore, a window function W2 shifted by N/2, which is half the time width N, from the window function W1 is further used to generate a data sequence obtained by processing the data sequence of the period B. In this case, the time-domain data sequence to which the window function W1 is applied is processed to generate a data sequence of a period A, and the time-domain data sequence to which the window function W3 is applied is processed to generate a data sequence of a period C. As a result, in the half-overlap, a data sequence obtained by processing the entire period from the period A to the period C can be generated while an increase in error is suppressed.

In such an overlap, there is a delay in processing corresponding to an amount of overlap of the window function. In the case of a half-overlap, as an example, when a sampling period of a signal is 48 kHz, the delay time is calculated as (N/2)×(1/48 kHz) and is approximately 0.0027 seconds. It is known that, in a conference system, karaoke, a live audio transmission system, or the like that uses an audio signal, a delay of about 0.003 seconds or more gives a sense of discomfort to a user. Therefore, when the conversion from the time domain to the frequency domain and the conversion from the frequency domain to the time domain cause a delay of approximately 0.0027 seconds, there is almost no time to perform other processing.

Therefore, an audio signal processing apparatus according to the present embodiment performs the signal processing or the like of the audio signal at a higher speed without using the conventional overlap. Such an audio signal processing apparatus will be described below.

<Configuration Example of an Audio Signal Processing Apparatus 10>

Figure 2:
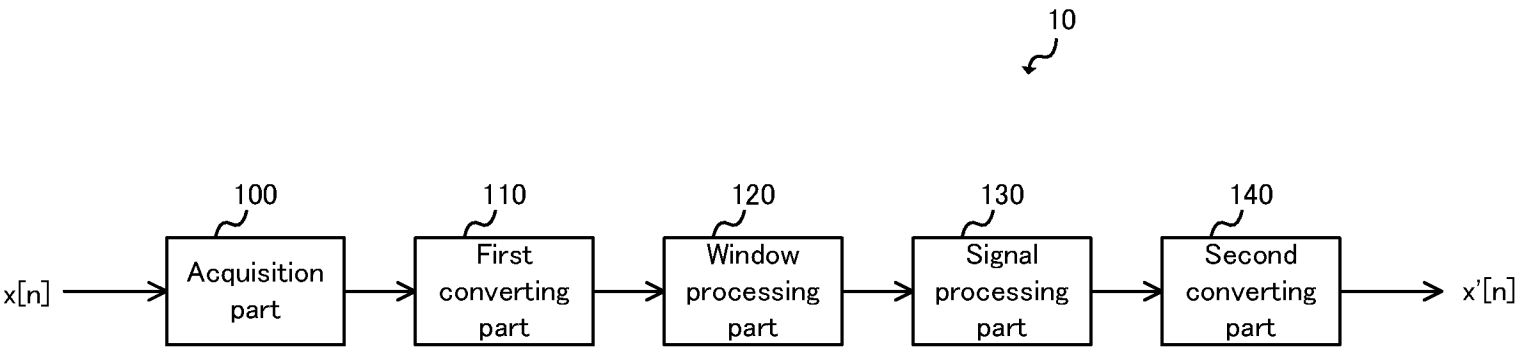
FIG. 2 shows a configuration example of an audio signal processing apparatus 10 according to the present embodiment.

FIG. 2 shows a configuration example of an audio signal processing apparatus 10 according to the present embodiment. A data sequence indicating an audio signal is input to the audio signal processing apparatus 10. The audio signal is, for example, a signal output from a microphone or the like. The audio signal processing apparatus 10 first applies predetermined signal processing to the input data sequence, and then outputs the signal-processed audio signal. The audio signal processing apparatus 10 performs, for example, noise reduction processing, howling reduction processing, or the like on the audio signal. The audio signal processing apparatus 10 includes an acquisition part 100, a first converting part 110, a window processing part 120, a signal processing part 130, and a second converting part 140.

The acquisition part 100 acquires a data sequence of an audio signal. The acquisition part 100 acquires the data sequence for executing predetermined signal processing. The acquisition part 100 acquires, for example, the data sequence from a transmitter, an A/D converter, a storage device, or the like. The acquisition part 100 may be connected to networks or the like to acquire the data sequence stored in a database or the like. The data sequence includes, for example, a plurality of pieces of data arranged in a time series.

The acquisition part 100 acquires, for example, pieces of data of the data sequence one by one at each processing timing. Alternatively, the acquisition part 100 may acquire the data of the data sequence a predetermined number of points at a time at each processing timing. The processing timing is, for example, a timing synchronized with a clock signal or the like.

The first converting part 110 converts an input data sequence of an audio signal into frequency data using the IIR system DFT at each processing timing. The IIR system DFT converts input data into frequency data on the basis of a transfer function of the following equation. The transfer function is calculated by using the Lagrange interpolation to calculate, for example, the (N−1)th order polynomial H(z) for $z^{-1}$, which takes the specified value $H(z_k)$ in N pieces of data $z_k$ (k=0, 1, 2, . . . , N−1).

$$H(z) = \frac{1 - r^N z^{-N}}{N} \sum_{k=0}^{N-1} \frac{H\left(e^{j\left(\frac{2\pi}{N}\right)k}\right)}{1 - rz^{-1} e^{j\left(\frac{2\pi}{N}\right)k}} \quad \text{[Equation 1]}$$

The IIR system DFT is a filter in which the DFT is realized by the IIR. Details of the IIR system DFT are described, for example, in Non-Patent Document 1 and the like, and therefore the descriptions thereof are omitted here. In Equation 1, "j" is an imaginary unit ($j^2=-1$), and "r" is a real number greater than 0 and smaller than 1. "r" is a parameter used for preventing a circuit from becoming unstable due to a pole getting outside of a unit circle in an IIR filter.

The first converting part 110 calculates, for example at each processing timing, a frequency-domain data sequence on the basis of values of N−1 pieces of data in the input data sequence from data x(n) to data x(n−N+1), which is N−1 pieces prior to the data x(n).

Since the first converting part 110 converts the time-domain data sequence into the frequency-domain data sequence using such an IIR system DFT, the first converting part 110 carries out the conversion process using a smaller storage area and less computation, as compared with a typical DFT. For example, when discrete Fourier transforming a data sequence in which the number of data points is N, it is known that the number of times required for the number of complex multiplications is $N^2$ or approximately $N \times \log_2 N$. In contrast, in the IIR system DFT, the number of multiplications can be reduced to approximately N times.

It should be noted that, in general, in window processing of a DFT, N pieces of data in the time-domain data sequence are multiplied by a window function, and then a frequency conversion is performed using the N pieces of data after the multiplication. However, unlike the DFT, the IIR system DFT calculates, at each processing timing, the frequency-domain data sequence using the past output and a single new piece of data. As described above, normal window processing cannot be applied in the IIR system DFT since the frequency conversion is performed using one piece of data within the time-domain data sequence.

For this reason, the window processing part 120 performs the window processing using a window function on the frequency data which the first converting part 110 has converted. Here, for example, it is assumed that a window function h(n) is represented by a linear combination of a trigonometric function such as the following equation:

$$h(n) = \sum_{m=0}^{M-1} \alpha_m \cos\left(\frac{m}{N} n\right) \quad \text{[Equation 2]}$$

Equation 2 can be substituted as the following equation:

$$h(n) = \sum_{m=0}^{M-1} \alpha_m \frac{W^{mn} + \bar{W}^{mn}}{2} \quad \text{[Equation 3]}$$

$$W^{mn} = \left\{ e^{\frac{2\pi j}{N}} \right\}^{mn},$$

$\overline{W}^{mn}$ is a complex conjugate of $W^{mn}$

Next, the discrete Fourier transform of the window processing is considered as the following equation, and Equation 3 is inserted therein. Here, k=0, 1, 2, . . . , N−1. Also, {F(n): n=0, 1, 2, . . . , N−1} is the discrete Fourier transform of {x(n): n=0, 1, 2, . . . , N−1}.

$$\sum_{n=0}^{N-1} x(n)h(n)(\bar{W}^k)^n = \sum_{n=0}^{N-1} x(n)\left\{\sum_{m=0}^{M-1} \alpha_m \frac{W^{mn} + \bar{W}^{mn}}{2}\right\}(\bar{W}^k)^n = \frac{1}{2}\left(\sum_{m=0}^{M-1} \alpha_m \sum_{n=0}^{N-1} x(n)\left(\bar{W}^{(k-m)n} + \bar{W}^{(k+m)n}\right)\right) = \frac{1}{2}\left(\sum_{m=0}^{M-1} \alpha_m \{F(k-m) + F(k+m)\}\right) \quad \text{[Equation 4]}$$

From Equation 4, the time-domain data sequence, to which the window processing is applied by multiplying the time-domain data sequence x(n) by the window function h(n) first and then performing the discrete Fourier transform, coincides with convolution of the discrete Fourier transform of the data sequence x(n) and the window function h(n). Therefore, the window processing part 120 performs the window processing by convolving (i) a first function obtained by performing the DFT on the window function h(n) and (ii) the frequency data converted by the first converting part 110. That is, the window processing part 120 performs the window processing on the frequency data which the first converting part 110 output using the IIR system DFT.

Assuming that the order of the window functions is M, the number of multiplications of the convolution operation is approximately N×M, and the sum of the multiplications of the IIR system DFT of the first converting part 110 and the number of multiplications of convolution operation is approximately N×(M+1). Therefore, unless M is an extremely large value, processing from the first converting part 110 to the window processing part 120 can be executed faster than the DFT. The window processing part 120 performs, for example, such a window processing at each processing timing.

The signal processing part 130 performs predetermined signal processing on the frequency data on which the window processing has been performed. The signal processing part 130 performs signal processing that is to be applied to the audio signal input to the audio signal processing apparatus 10. For example, the signal processing part 130 performs noise reduction processing, howling reduction processing, or the like. Frequency-domain data which the window processing part 120 outputs approximately coincides with the frequency-domain data to which the window processing is applied by multiplying the time-domain data sequence by the window function first and then performing the discrete Fourier transform. Therefore, the signal processing part 130 may simply perform known signal processing. It should be noted that a detailed description of known signal processing to be performed by the signal processing part 130 is omitted.

The second converting part 140 converts the frequency data on which the signal processing has been performed into a time-axis data sequence. The second converting part 140 converts, for example by IDFT processing, the frequency-domain data into time-domain data. The IDFT processing may be known signal processing, and its detailed description is omitted here.

The audio signal processing apparatus 10 according to the present embodiment described above can convert the audio signal or the like into frequency data at high speed by performing the window processing corresponding to the IIR system DFT. Therefore, the audio signal processing apparatus 10 according to the present embodiment can output the audio signal or the like to which the predetermined signal processing is applied while reducing the delay time.

The first converting part 110 also converts an audio signal into frequency data at each processing timing using the IIR system DFT. Therefore, as will be described later, the second converting part 140 may employ and output one piece of data corresponding to a portion where the window function is flattened among the time-domain data converted at each processing timing. Therefore, the above-described audio signal processing apparatus 10 can perform the predetermined signal processing and appropriately convert the audio signal into frequency data, without overlapping the window function in the time-domain data sequence. In other words, the audio signal processing apparatus 10 processes the audio signal or the like at a higher speed since the time delay due to overlap does not occur.

In the audio signal processing apparatus 10 mentioned above, the second converting part 140 has been described as the example of converting the frequency data into the time-axis data sequence by the normal IDFT processing, but is not limited thereto. The second converting part 140 may execute faster conversion processing as described below.

<Conversion Processing of the Second Converting Part 140>

Here, a matrix $[W^{km}]$ indicating the discrete inverse Fourier transform is shown by the following equation:

$$[W^{km}] = \begin{bmatrix} (W^0)^0 & \cdots & (W^0)^{N-1} \\ \vdots & \ddots & \vdots \\ (W^{N-1})^0 & \cdots & (W^{N-1})^{N-1} \end{bmatrix} \quad \text{[Equation 5]}$$

Since $[W^{km}]$ is a unitary matrix, when an identity matrix is E, the following equation is established:

$$[W^{km}][\overline{W}^{km}]=E \quad \text{[Equation 6]}$$

Here, when the frequency data the signal processing part 130 outputs is {F(n): n=0, 1, 2, . . . , N−1}, the second converting part 140 calculates the inverse discrete Fourier transform of F(n). Here, the inverse discrete Fourier transform of F(n) is expressed as $\{h(n)r^n x'(n)$: n=0, 1, 2, . . . , N−1}, and the following equation is established.

$$\begin{bmatrix} h(0)r^0x'(0) \\ \vdots \\ h(N-1)r^{N-1}x'(N-1) \end{bmatrix} = E\begin{bmatrix} h(0)r^0x'(0) \\ \vdots \\ h(N-1)r^{N-1}x'(N-1) \end{bmatrix} = \quad \text{[Equation 7]}$$

$$[W^{km}][\overline{W}^{km}]\begin{bmatrix} h(0)r^0x'(0) \\ \vdots \\ h(N-1)r^{N-1}x'(N-1) \end{bmatrix} = [W^{km}]\begin{bmatrix} F(0) \\ \vdots \\ F(N-1) \end{bmatrix}$$

From Equation 7, the m-th piece of data among the results of the inverse discrete Fourier transform of F(n) is expressed by the following equation:

$$h(m)r^m x'(m)=\Sigma_{k=0}^{N-1}(W^m)^n F(k) \quad \text{[Equation 8]}$$

Here, the second converting part 140 may output a time-domain data sequence x'(n) on which signal processing has been performed in response to a time-domain data sequence x(n) acquired by the acquisition part 100. In other words, the second converting part 140 just needs to calculate the time-domain data sequence x'(n) corresponding to the time-domain data sequence x(n) among the results of the inverse discrete Fourier transform of F(n). For example, the second converting part 140 calculates, on the basis of Equation 8, a time-axis data sequence data x'(m) of a time-axis data sequence from the frequency data having the number of data points N on the basis of the product of a coefficient W ($=e^{2\pi j/N}$) and the frequency data F(n) on which the signal processing has been performed, as shown in the following equation.

$$x'(m) = \frac{\sum_{k=0}^{N-1}(W^m)^k F(k)}{h(m)r^m} \quad \text{[Equation 9]}$$

The second converting part 140 calculates, for example, Equation 9 at each processing timing. When performing an inverse discrete Fourier transform on the data sequence having the number of data points N, in a similar manner as in the DFT, it is known that the number of complex multiplications needs to be approximately $N\times\log_2 N$. On the other hand, the second converting part 140 can reduce the number of complex multiplications to approximately N by using Equation 9.

In Equation 9, "r" is a parameter used in the above-described IIR system DFT. Further, "m" is a delay parameter whose value is determined corresponding to the window function. Since the window function h(n) is used to make the input data sequence a periodic function corresponding to the interval N, for example, the window function h(n) is formed such that the value converges to 0 as it approaches a head h(0) or a tail h(N−1). Therefore, the data x'(0) corresponding to the head h(0) and the data x'(N−1) corresponding to the tail h(N−1) have the smallest denominator, and the accuracy becomes uncertain.

Therefore, in the second converting part 140, it is preferable to calculate the data x'(m) by increasing the value of m to such an extent that the value of the window function becomes sufficiently large. However, when the value of m increases, there may be cases where a processing time for the second converting part 140 to calculate the data x'(m) increases. Therefore, it is more preferable that an appropriate value of m is set in advance in accordance with the window function to be used. For example, when the value of the data of the window function is normalized by the maximum value, specifically, the data value of the window function is normalized using min-max normalization, the value of m is set such that the data value becomes 0.5 or more. In this case, it is preferable that the value of m is set such that the value of the data of the window function becomes 0.7, and it is more preferable that the value of m is set such that the value of the data of the window function becomes 0.8.

Here, the window processing part 120 may use, for example, a known window function. For example, the window function is a Gaussian window, Hann window, Hamming window, Tukey window, Hanning window, Blackman window, Kaiser window, or the like. These known window functions are functions where (i) the values of the data near the head h(0) are close to zero and (ii) the values of the data become large relatively gradually. For this reason, m as an appropriate value is set to, for example, a value equal to or more than 30% of the number of data points N. Therefore, the calculation of time-axis data of the second converting part 140 may be accelerated by using a window function with a steeper rise. In other words, when the delay parameter m is set to a value obtained by multiplying the number of data points N by a ratio of less than 30%, it is desirable to use a window function such that the data value h(m) of the normalized window function at a position shifted from the head to the tail by the delay parameter m becomes 0.8 or more. An example of such a window function with the sharp rise will be described next.

<Generating the Window Function>

An example of a window function with a sharp rise is a window function formed by a linear combination of seventh order trigonometric function. As an example, such a window function can be calculated by using the method of Lagrange multipliers in which the coefficient $\{\alpha_m$: m=0, 1, . . . , M−1} of the window function represented by Equation 2 is represented by the following equation. Here, N=256, and M=8.

$$E(\alpha_0, \ldots, \alpha_{M-1}) = \sum_{n=m_1}^{N-m_1}(h(n)-1)^2 + \gamma(h(0)-0) + \mu\left(h\left(\frac{N}{2}\right)-1\right) + \sigma(h(27)-0.8) \quad \text{[Equation 10]}$$

In Equation 10, $m_1$ indicates a starting point of the horizontal portion of the window function, $N-m_1$ indicates an ending point of the horizontal portion of the window function, the first term on the right side indicates the sum of the least squares of the horizontal portion, the second term on the right side indicates h(0)=0, the third term on the right side indicates h(N/2)=1, and the fourth term on the right side indicates that the 27th value is 0.8. The coefficient $\{\alpha_m$: m=0, 1, . . . , M−1} shown in Equation 10 can be calculated as shown in FIG. 3 by partially differentiating the right side with $\{\alpha_m$: m=0, 1, . . . , M−1}, λ, μ, and σ, and setting the left side equal to 0.

As described above, in the window function formed by the linear combination of the seventh order trigonometric function, for example among 256 data points, the 27th value can be 0.8 when the value of the flat region is 1, the 0th value is 0, and r=0.995. In other words, the generated window function has a sharp rise. In this case, for example, since the delay parameter m of Equation 9 can be set to a value of approximately 30, which is approximately 10% of the number of data points N, the second converting part 140 can calculate the time-axis data at a higher speed.

As an example of the window function, the linear combination of the seventh order trigonometric function has been described, but it is not limited thereto. The window function may be a window function having a sharp rise and a lower order. For example, the window function may be a linear combination of trigonometric functions from the sixth order to the tenth order, and may preferably be a linear combination of trigonometric functions from the seventh order to the ninth order. Whichever linear combination of such trigonometric functions is selected, by using the method of Lagrangian multipliers as already describe, the window processing part 120 can use the appropriately calculated window function.

The audio signal processing apparatus 10 according to the present embodiment may function as at least a part of an audio signal processing system. For example, the audio signal processing apparatus 10 forms an audio input device and an audio signal processing system that output an audio signal. In other words, the audio signal processing system includes, for example, the audio input device and the audio signal processing apparatus 10. The audio input device outputs an input voice as an audio signal. The audio input device is, for example, a microphone.

The audio signal processing apparatus 10 performs signal processing predetermined in the audio signal output by such an audio input device. The audio signal processing apparatus 10 receives the audio signal wirelessly or by wire from the audio input device. The audio signal processing apparatus 10 receives the audio signal from the audio input device by infrared communication, as an example. Such an audio signal processing system can function as a karaoke machine, a conference system, a live audio transmission system, or the like.

It is preferable that at least a part of the audio signal processing apparatus 10 according to the present embodiment described above is formed by an integrated circuit or the like. For example, the audio signal processing apparatus 10 may include a field programmable gate array (FPGA), a digital signal processor (DSP), and/or a central processing unit (CPU).

When at least a part of the audio signal processing apparatus 10 is formed by a computer or the like, the audio signal processing apparatus 10 includes a storage unit. The storage unit includes, for example, a read only memory (ROM) storing a basic input output system (BIOS) or the like of the computer or the like that realizes the audio signal processing apparatus 10, and a random access memory (RAM) serving as a work area. Also, the storage unit may store various pieces of information including an operating system (OS), application programs, and/or a database that is referenced when executing the application programs. That is, the storage unit may include a large capacity device like a hard disk drive (HDD) and/or a solid state drive (SSD).

The processors such as the CPU and the like function as the acquisition part 100, the first converting part 110, the window processing part 120, the signal processing part 130, and the second converting part 140 by executing programs stored in the storage unit. The audio signal processing apparatus 10 may include a graphics processing unit (GPU) or the like.

The present disclosure is explained on the basis of the exemplary embodiments. The technical scope of the present disclosure is not limited to the scope explained in the above embodiments and it is possible to make various changes and modifications within the scope of the disclosure. For example, all or part of the apparatus can be configured to be functionally or physically distributed and integrated in arbitrary units. Further, new exemplary embodiments generated by arbitrary combinations of them are included in the exemplary embodiments of the present disclosure. The effect of the new embodiment caused by the combination has the effect of the original embodiment together.

What is claimed is:

1. An audio signal processing apparatus, comprising:

a first converting part that converts an input data sequence of an audio signal into frequency data using an IIR system DFT at each processing timing;

a window processing part that performs window processing on the frequency data using a window function;

a signal processing part that performs predetermined signal processing on the frequency data on which the window processing has been performed; and a second converting part that converts the frequency data, on which the signal processing has been performed, into a time-axis data sequence, wherein the second converting part calculates data of the time-axis data sequence from the frequency data having a number of data points N on a basis of a product of a coefficient W ($=e^{2\pi j/N}$) and the frequency data on which the signal processing has been performed, wherein the second converting part calculates the data of the time-axis data sequence using a delay parameter m whose value is determined corresponding to the window function, wherein the second converting part calculates the data of the time-axis data sequence by using $$x'^{(m)} = \frac{\sum_{k=0}^{N-1} (W^m)^k F(k)}{h(m) r^m} \tag{1}$$

where x'(n) is the data of the time-axis data sequence, h(n) is the window function, F(n) is the frequency data on which the signal processing has been performed, and r is a parameter used in the IIR system DFT.

2. The audio signal processing apparatus according to claim 1, wherein the window processing part performs the window processing by convolving a first function obtained by performing a DFT on the window function and the frequency data.

3. The audio signal processing apparatus according to claim 1, wherein the window function is formed by a linear combination of the seventh order trigonometric function.

4. The audio signal processing apparatus according to claim 1, wherein the second converting part normalizes a data value of the window function using a maximum value, and then calculates the data of the time-axis data sequence by setting the delay parameter m to be a value of n such that the data value h(n) of the window function becomes 0.8 or more.

5. The audio signal processing apparatus according to claim 1, wherein the delay parameter m is set to be an integer value obtained by multiplying the number of data points N by a ratio of equal to or more than 10% and less than 30%, and the window function is formed such that, a data value h(0) of a head of a window and a data value h(N−1) of a tail of the window are 0 when the data value of the window function is normalized by the maximum value, and a data value h(m) at a position shifted from the head to the tail by the delay parameter m is 0.8 or more.

6. The audio signal processing apparatus according to claim 1, wherein the signal processing performed by the signal processing part includes at least one of noise reduction processing or howling reduction processing.

7. An audio signal processing system comprising:

an audio input device that outputs an input voice as an audio signal; and an audio signal processing apparatus that performs predetermined signal processing on the audio signal output from the audio input device, wherein the audio signal processing apparatus includes:

an acquisition part that acquires a data sequence of an audio signal output by the audio input device;

a first converting part that converts the data sequence of the audio signal into frequency data using an IIR system DFT at each processing timing;

a window processing part that performs window processing on the frequency data using a window function;

a signal processing part that performs the predetermined signal processing on the frequency data on which the window processing has been performed; and a second converting part that converts the frequency data, on which the signal processing has been performed, into a time-axis data sequence, wherein the second converting part calculates data of the time-axis data sequence from the frequency data having a number of data points N on a basis of a product of a coefficient W ($=e^{2\pi j/N}$) and the frequency data on which the signal processing has been performed, wherein the second converting part calculates the data of the time-axis data sequence using a delay parameter m whose value is determined corresponding to the window function, wherein the second converting part calculates the data of the time-axis data sequence by using $$x'(m) = \frac{\sum_{k=0}^{N-1} (W^m)^k F(k)}{h(m) r^m} \quad (1)$$

where x'(n) is the data of the time-axis data sequence, h(n) is the window function, F(n) is the frequency data on which the signal processing has been performed, and r is a parameter used in the IIR system DFT.

8. An audio signal processing method comprising:

converting an input data sequence of an audio signal into frequency data using an IIR system DFT at each processing timing;

performing window processing on the frequency data using a window function;

performing predetermined signal processing on the frequency data on which the window processing has been performed; and converting the frequency data, on which the signal processing has been performed, into a time-axis data sequence, wherein the second converting step calculates data of the time-axis data sequence from the frequency data having a number of data points N on a basis of a product of a coefficient W ($=e^{2\pi j/N}$) and the frequency data on which the signal processing has been performed, wherein the second converting step calculates the data of the time-axis data sequence using a delay parameter m whose value is determined corresponding to the window function, wherein the second converting step calculates the data of the time-axis data sequence by using $$x'(m) = \frac{\sum_{k=0}^{N-1} (W^m)^k F(k)}{h(m) r^m} \quad (1)$$

where x'(n) is the data of the time-axis data sequence, h(n) is the window function, F(n) is the frequency data on which the signal processing has been performed, and r is a parameter used in the IIR system DFT.

* * * * *